US006868629B2

(12) United States Patent
Fast et al.

(10) Patent No.: US 6,868,629 B2
(45) Date of Patent: Mar. 22, 2005

(54) LABEL HOLDER FOR MOIST ENVIRONMENTS

(75) Inventors: Jacob Fast, Boca Raton, FL (US); Michael G. Lowry, Boca Raton, FL (US); Edward J. Cigoi, Palm Harbor, FL (US); Paul McKallagat, Atkinson, NH (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 0 days.

(21) Appl. No.: 10/687,868

(22) Filed: Oct. 20, 2003

(65) Prior Publication Data

US 2004/0120750 A1 Jun. 24, 2004

Related U.S. Application Data

(60) Provisional application No. 60/437,263, filed on Jan. 2, 2003, and provisional application No. 60/433,982, filed on Dec. 18, 2002, now abandoned.

(51) Int. Cl.[7] ..... G09F 3/18

(52) U.S. Cl. ..... 40/661.03; 40/649; 101/407.1

(58) Field of Search ..... 101/407.1; 40/661.03, 40/649, 661.08, 642.02

(56) References Cited

U.S. PATENT DOCUMENTS

| | | | | |
|---|---|---|---|---|
| 4,485,575 | A | | 12/1984 | Fast |
| 4,531,313 | A | | 7/1985 | Fast |
| 4,625,441 | A | | 12/1986 | Fast |
| 4,704,813 | A | | 11/1987 | Fast |
| 4,713,899 | A | | 12/1987 | Fast |
| 4,917,342 | A | | 4/1990 | Fast |
| 4,995,182 | A | | 2/1991 | Fast |
| 5,458,307 | A | | 10/1995 | Gebka |
| 5,488,793 | A | | 2/1996 | Gebka |
| 5,515,632 | A | | 5/1996 | Gebka et al. |
| 5,682,698 | A | | 11/1997 | Bevins |
| 5,899,011 | A | | 5/1999 | Brinkman |
| 6,105,295 | A | | 8/2000 | Brinkman et al. |
| 6,163,996 | A | | 12/2000 | Gebka |
| 6,266,906 | B1 | * | 7/2001 | Nagel ..... 40/661.03 |
| 6,470,613 | B1 | * | 10/2002 | Wildrick ..... 40/661.03 |
| 6,523,291 | B2 | * | 2/2003 | Nagel ..... 40/661 |
| 6,553,702 | B1 | * | 4/2003 | Bacnik ..... 40/661.03 |
| 6,568,112 | B2 | | 5/2003 | Lowry et al. |
| 6,665,971 | B2 | * | 12/2003 | Lowry et al. ..... 40/661 |
| 6,708,436 | B2 | * | 3/2004 | Nagel ..... 40/661.01 |

* cited by examiner

*Primary Examiner*—Andrew H. Hirshfeld
*Assistant Examiner*—Dave A. Ghatt
(74) *Attorney, Agent, or Firm*—Jacobson Holman PLLC

(57) ABSTRACT

A label holder for use in a moist environment including a body panel connected at its lower edge by a resilient hinge to a transparent cover member to form an openable pocket for labels therebetween. The body panel is secured to a supporting surface by adhesive or may include an attachment panel connected to the rear of the body panel by a resilient spacer so that the attachment panel can be flexed for engagement in a C-channel. A downwardly and forwardly extending lip is formed on the top edge of the body panel and the top edge of the cover member is secured thereunder in the closed position of the cover member. A downwardly and forwardly extending ledge member is formed on the top edge of the cover member and extends beyond the lip member to a freely extending edge to dissipate moisture forming on the lip member. The mating side edges of the body panel may be sealed with strips of a resilient material to limit moisture from entering the label-receiving pocket. Alternatively, the entire front face of the body panel may be covered with a resilient material or the body panel itself may be formed of a resilient material to seal the edges.

33 Claims, 2 Drawing Sheets

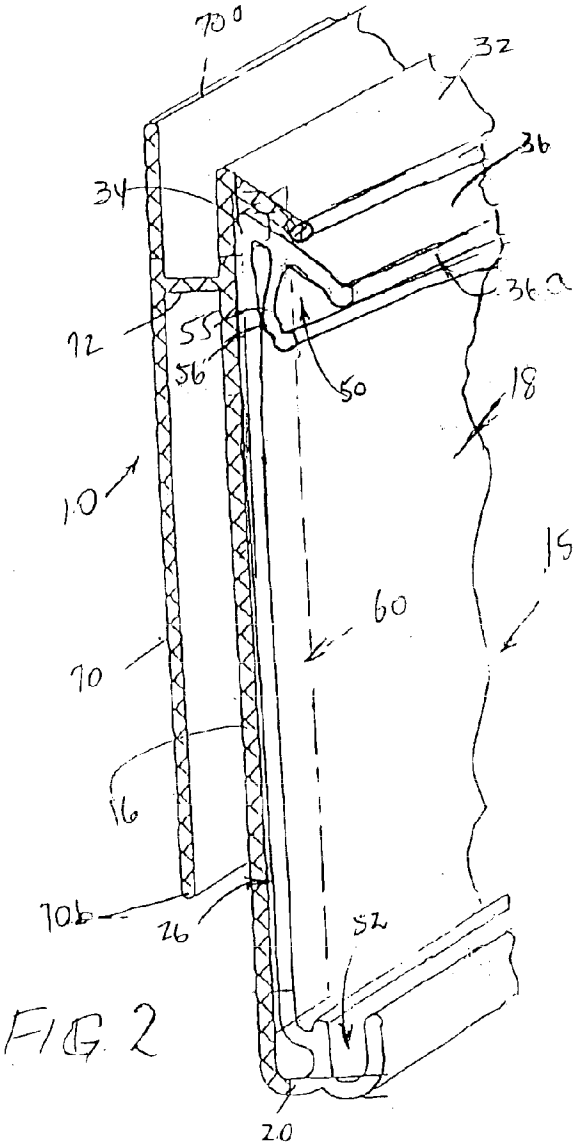
FIG. 2
PRIOR ART
FIG. 1
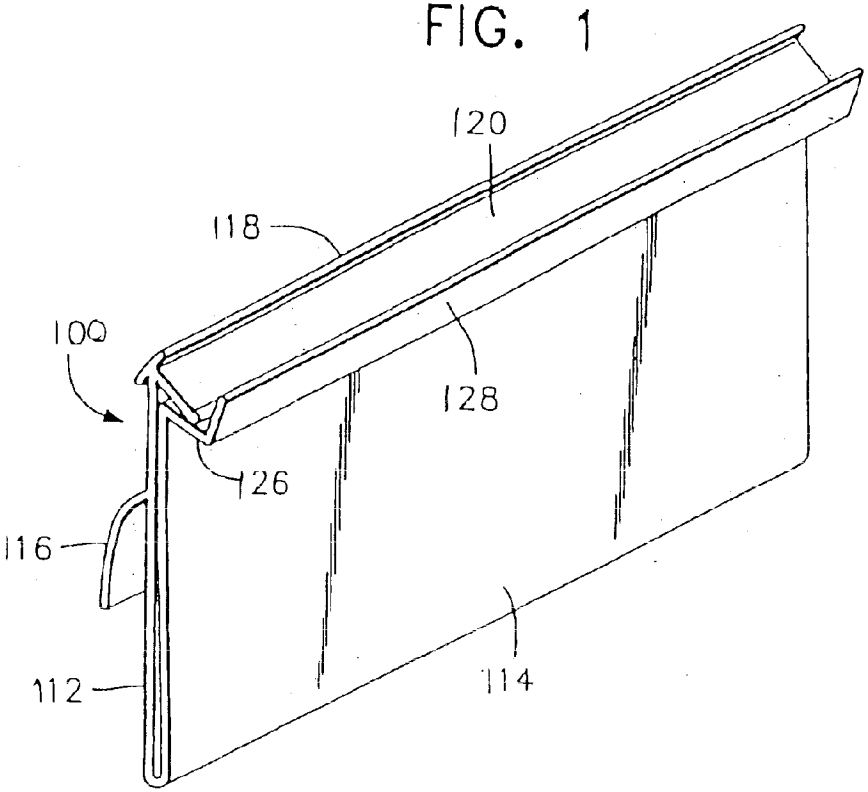

LABEL HOLDER FOR MOIST ENVIRONMENTS

This is a complete application claiming benefit of provisional application Ser. No. 60/433,982 filed Dec. 18, 2002 now abandoned and application Ser. No. 60/437,263 filed Jan. 2, 2003.

BACKGROUND OF THE INVENTION

1. Field of the Invention

This invention relates to merchandising aids, and relates more particularly to a label holder to be used in moist environments such as deli or meat cases or fruit and/or vegetable cases. Such label holders are usually designed to removably receive non-adhesive labels to display consumer information such as descriptions and prices of products, as well as inventory control information such as barcodes and the like. In some instances, the label holders can be combined with a sign holder adapted to carry a "flag" or sign displaying special information to the consumer such as identifying a "sale" item or the like. However, a particular problem exists when a label holder is to be used in a location subject to significant amounts of moisture such as the condensation commonly found in chilled displays of deli and meat cases or displays of fruits and vegetables which are sprayed from time to time to keep the products fresh. In such environments, water can enter the label holder, damaging the labels and providing a site for bacteria or mold to grow, an unsightly condition at best, and a dangerous condition, particularly in the vicinity of fresh food.

2. Discussion of the Related Art

"C-channels" are commonly found in merchandise outlets such as supermarkets or the like, and are formed with spaced upper and lower opposed lips to provide a convenient means for mounting many different kinds of fit-in articles, such as labels, label holders, signs or sign holder which provide information relating to merchandise juxtaposed thereto. While adhesive-backed labels can be secured directly to a supporting surface or even directly on the surface of a C-channel, removing such labels is time consuming and difficult, leaving an unsightly residue build-up. For many applications, therefore, non-adhesive paper or plastic labels are preferred since they can easily be replaced if they become damaged or the product information changes. While such non-adhesive labels can sometimes simply be fitted directly between the lips of the C-channel, more commonly, label holders are provided which have a back or body panel attached in some fashion to the supporting surface, with a transparent cover member flexibly secured along one mating edge to the body panel to define between the front surface of the body panel and the rear surface of the cover member a pocket for removable reception of one or more such information-containing labels.

Label holders are generally provided in elongated sections, perhaps 4' or more in width, and may be secured by adhesive strips or the like to any supporting surface. However, for most applications, such label holders are designed to be fitted directly in a C-channel of a product display shelf or a case or bin containing products. Various prior art embodiments of such label holders can be seen in commonly assigned U.S. Pat. Nos. 4,713,899, 5,458,307, 5,488,793, 5,682,698, 5,899,011 and 6,105,295. A particularly desirable label holder having a "lockable" cover feature designed to secure and protect the labels within the pocket is seen in U.S. Pat. No. 5,515,632 (the '632 patent). The disclosures of all of the foregoing patents are incorporated herein in their entireties by reference.

Sometimes, in addition to the information provided by the product labels, it is desired to highlight certain information about a particular product or group of products by displaying an enlarged "flag" or sign. Different forms of "sign holders" are also well known in the merchandising art, examples of which can be seen in the aforementioned U.S. Pat. No. 5,488,793, as well as commonly assigned U.S. Pat. Nos. 4,485,575, 4,531,313, 4,625,441, 4,704,813, 4,917,342, 4,995,182, 5,682,698, and 6,163,996, the subject matters of which are also incorporated herein in their entireties by reference. As seen in some of the aforementioned patents, such sign holders may be designed to be supported partially or entirely in the same C-channels as the label holders. A combination label/sign holder adapted to support multiple sign holders of various forms directly on the cover of a label holder, permitting access to labels carried by the label holder pocket without removing the sign holders, is disclosed in commonly assigned, U.S. Pat. No. 6,568,112 granted May 27, 2003 (the '112 patent), the subject matter of which is incorporated herein in its entirety by reference.

Regardless of the specific nature of the label holder or label/sign holder, prior art label holders, as seen in the '632 patent and the '112 patent, have an upwardly and outwardly extending flange carried by the top of the cover panel member adapted to facilitate releasing the "locking" engagement of the cover member with an overlying lip carried by the top of the body panel when it is desired to place or replace labels in the label holder pocket. While such a construction is highly desirable in many applications, it has been found to be a source of contamination when the label holder is used in a moist environment since it tends to collect moisture which can flow back into the label holder pocket as discussed above. Moreover, label holders of this nature can permit water to enter the label holder pocket from the sides providing additional sites for the growth of mold or bacteria.

SUMMARY OF THE INVENTION

A primary object of this invention is to provide a label holder for use in moist environments which precludes the entry of water into the label holder pocket.

A further object of this invention is to provide a label holder, which may or may not incorporate sign holder-receiving lip members and/or a sign holding grip integrally formed on its cover, but which includes an outwardly and downwardly extending ledge element at the top of the cover member designed to channel moisture from above over the front of the label holder away from the label holder pocket.

A still further object of this invention is to provide a label holder which incorporates sealing means at least at the side edges of the label holder pocket to further preclude the entry of water into the label holder pocket.

Yet another object of this invention is to provide a label holder which includes a layer of a resilient material such as rubber or a closed-cellular foam plastic at least at the side edges of the label holder pocket, such as strips of such material on each side edge adhesively or otherwise affixed to the body panel or the cover member to seal the side edges against invasion of moisture or water.

Still another object of this invention is to provide a label holder of the type described wherein an entire layer of, for example, a closed-cellular polyurethane foam is co-extruded on the inside of the body panel to provide a sealing surface limiting the entry of moisture into the label holder pocket. As a variation thereof, this invention provides for the body panel itself to be formed of the closed-cellular foam material or the like which sealingly engages against the co-extruded transparent cover member.

Other and further objects of the instant invention will become apparent from the ensuing description and claims read in conjunction with the attached drawings.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

FIG. 1 is a perspective view of a prior art label holder as seen in the '632 patent;

FIG. 2 is an enlarged perspective view of one embodiment of a label/sign holder according to this invention with portions of a sealing tape along the side of the label holder pocket shown in dotted lines;

Like reference characters refer to like part throughout the several views of the drawings.

DETAILED DESCRIPTION OF THE PREFERRED EMBODIMENTS

Figure 4:
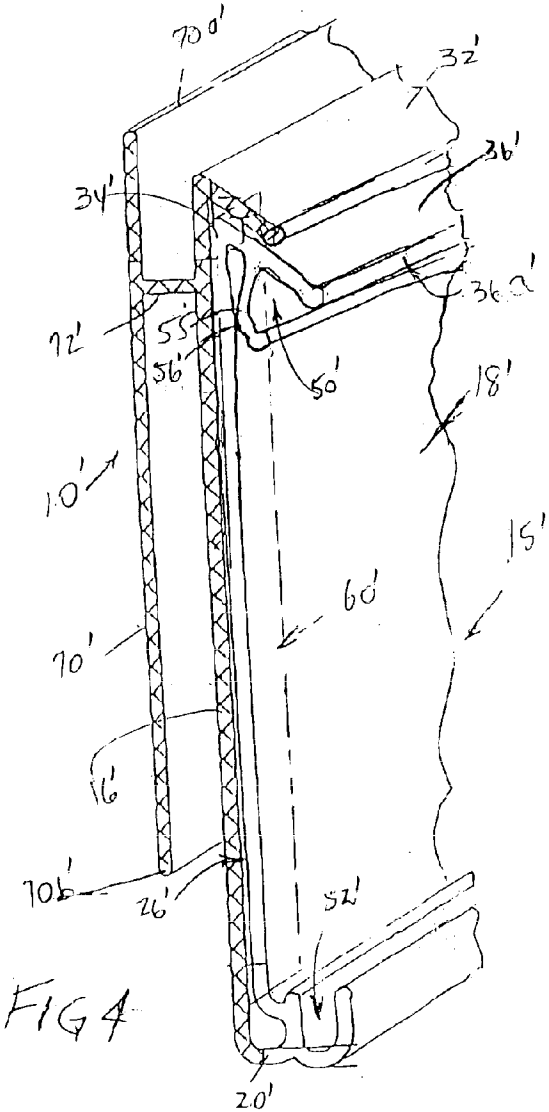
FIG. 4 is a view similar to FIG. 2 of a modified label/sign holder according to this invention.

FIG. 1 illustrates a prior art label holder as seen in the '632 patent. This prior art label holder 100 include a back or body panel 112 flexibly secured at its lower end to a transparent cover member 114. A rearwardly and downwardly extending leg 116 is attached to the rear of the body panel 112 and is adapted to engage in an upwardly opening pocket in a lower lip member of a C-channel (not shown in FIG. 1), the barb 118 engaging in a downwardly opening pocket of an upper lip member of the C-channel to secure the label holder 100 in use.

A downwardly extending flange 120 on the top of the body panel 112 interacts with a downwardly extending flange 126 on the top of the cover member 114 to effectively "lock" the cover member 114 in its closed position to preclude accidental loss of paper or plastic labels (not shown) carried within the pocket formed between the front of the body panel 112 and the rear of the cover member 114. In the prior art label holder 100, an upwardly and outwardly extending flange 128 is provided to facilitate disengaging the locking interaction between the cover member 114 and the body panel 112 when it is desired to open the cover member 114 to access the label holder pocket for removal or replacement of labels therewithin. As will be seen, however, the flanges 126, 128 together define a channel which tends to hold moisture in a wet environment. Such moisture can ultimately feed back along the flange 126 into the label holder pocket damaging the labels and providing a site for contamination by mold or bacteria. Water can also access the label holder pocket in such a prior art label holder from the unsealed sides.

Figure 3:
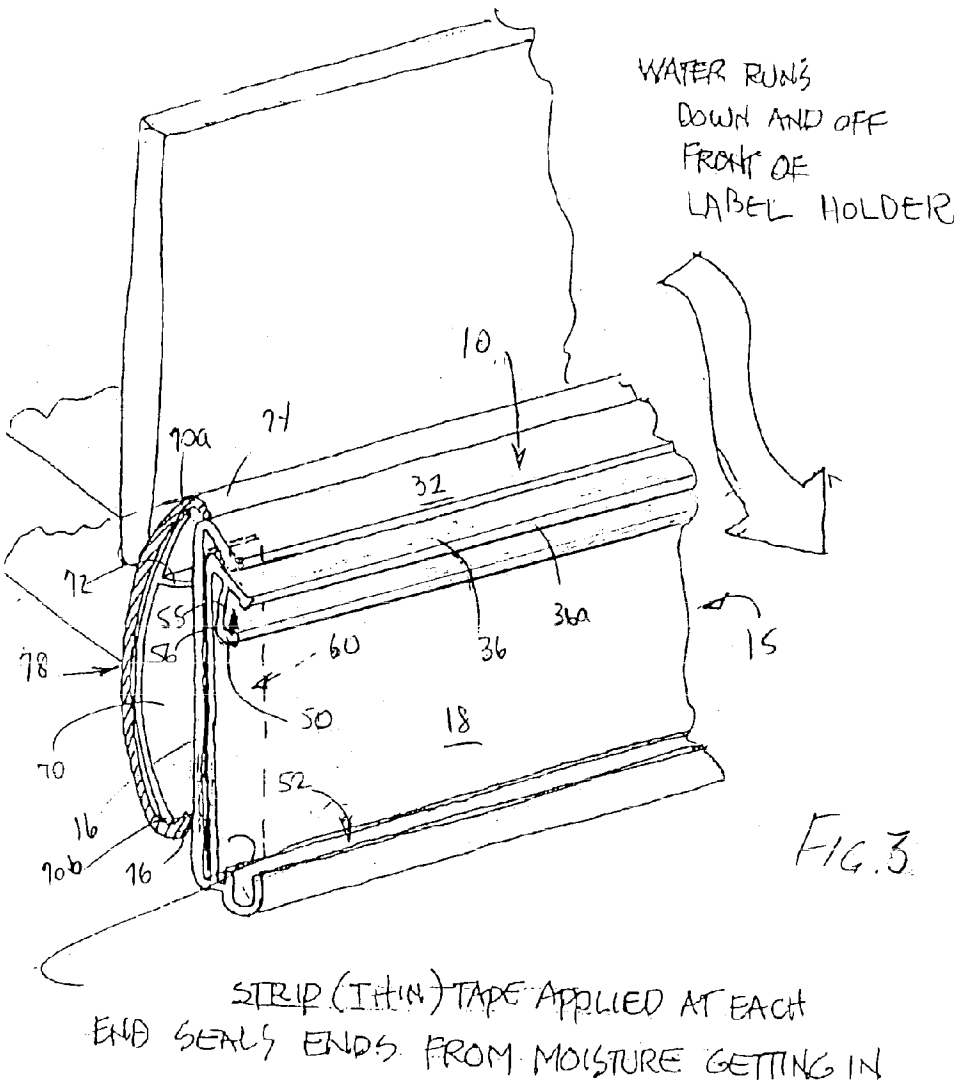
FIG. 3 is a perspective view, partially broken away for illustrative convenience, of one embodiment of the label/sign holder of FIG. 2 mounted in a C-channel with the outwardly and downwardly extending ledge element along the top of the cover member directing moisture or water down and off the front of the label holder.

In contrast, reference is now made to FIGS. 2 and 3 wherein, one embodiment of a label/sign holder according to this invention is illustrated at 10. The label/sign holder 10 is similar to one of the embodiments seen in the '112 patent, with the exception of the means provided by the instant inventive concepts to preclude environmental moisture from entering the label holder pocket. The merchandising aid 10 includes a label holder portion 15 formed by a back or body panel 16 and a cover member 18 flexibly secured to each other at a hinge or pivot portion 20. Except as discussed below, the material from which the merchandising aid 10 is made is not critical to the instant inventive concepts, although, commercially, such products are co-extruded from plastics materials, with the body panel 16 being formed of an opaque plastic and the cover member 18 being formed of a transparent material to enable passers-by to view information on one or more labels (not shown) captured in a pocket 26 formed between the front surface of the body panel 16 and the rear surface of the cover member 18. The cover member 18 can be tipped forwardly to facilitate the insertion or removal of a label from the pocket 26. The resilient nature of the hinge 20 will then normally bias the cover member 18 back toward its closed position.

In the embodiment shown in FIGS. 2 and 3, the upper edge portions of the base panel 16 include a forwardly and downwardly extending flange 32 and the upper edge portions 34 of the cover member 18 are lockingly engageable under the flange 32 to retain the cover member 18 in its closed and "locked" position and thereby secure labels in the pocket 26, particularly in the event the resilience of the connection between the base panel 16 and the cover member 18 weakens with continued use of the label holder 15. In accordance with this invention, a forwardly and downwardly extending ledge member 36 is carried by the upper edge portions 34 of the cover member 18 in lieu of the upwardly and outwardly extending flange 120 of the prior art label holder 100, to thereby direct moisture down and off the leading edge 36*a* over the front of the label holder portion 15 and away from the label holder pocket 26.

The manner in which the merchandising aid 10 is secured to a supporting surface will vary depending upon the nature of the supporting surface itself as will be readily recognized by those with ordinary skill in this art and is not a critical part of the instant invention concepts. Reference may be had to the leg 116 and the barb 118 of the label holder 100 of the '632 patent as seen in FIG. 1 or to the '112 patent for several embodiments of such mounting means. In FIGS. 2 and 3, one embodiment is illustrated in the nature of a generally vertically extending rear panel element 70 attached by a horizontal element 72 to the rear of the base panel 16 of the label holder portion 15, the upper and lower edges 70*a*, 70*b* of the rear panel element 70 being snappingly engaged between the upper and lower lips 74, 76 of a C-channel 78 such as seen, for example, in FIG. 3. This particular means for supporting the label/sign holder 10 is shown simply for illustrative purposes to emphasize the many ways in which the merchandising aid of this invention can be secured to a supporting surface.

The instant invention provides significant advantages when used with a label holder devoid of means to carry additional flags, signs or notes. However, as seen in the '112 patent and as shown in the drawings hereof, the cover member 18 of the label holder portion 15 may carry a sign holder such that the label holder can be opened without removing the sign holder. To that end, a pair of sign holder-receiving pockets 50, 52 may be integrally formed on the cover member 18, i.e., by extrusion. In this instance, the upper sign holder-receiving pocket 50 may be formed by the forwardly and downwardly extending ledge element 36 designed to cause water to run down and off the face of the cover member 18, the lower sign holder-receiving pocket 52 being formed by a lip member which extends forwardly and upwardly from the lower edge portions of the cover member 18.

A well-known spring clip form of sign holder (not shown) includes a spring plastic or metal element having oppositely extending edge portions adapted to be snappingly engaged in the sign holder-receiving pockets 50, 52 respectively, in an obvious manner. Alternatively, a sign holder of the type seen in U.S. Pat. No. 5,682,698 or 6,163,996 (not shown) can be secured in the pockets 50,52 of the cover member 18 in a well known manner. An additional upper grip member 55 may be provided behind the ledge element 36, the upper grip member 55 being closely positioned to the upper edge portions of the front face of the transparent cover member 18 to define between them a small pocket 56 adapted to slidingly receive and removably retain by friction the upper edge portions of an additional label, sign or the like (not shown) in a well known manner.

It will now be seen that the ledge element 36 not only forms the upper sign holder-receiving pocket 50, but directs moisture such as condensation in a deli or meat case or water that may be sprayed on fresh fruits or vegetables from entering the label receiving pocket 26 from above and thereby damaging the labels or contaminating the area around the food products by permitting the build-up of bacteria or mold. Moreover, by downward and inward or, more likely, upward and outward pressure on the ledge element 36, the cover member 18 may be released from its engagement beneath the flange 32 to enable the cover member 18 to be tipped forwardly to insert or remove labels from the pocket 26.

According to another feature of this invention as seen in FIGS. 2 and 3, the label holder pocket 26 may be further protected from entry of moisture by adhesively or otherwise securing a thin strip 60 of any resilient rubber or polymer material, such as closed-cellular foam polyurethane, to the front surface of the body panel 16 or the rear surface of the cover member 18, or both, at each side of the label holder portion 15. One such element is seen in dotted lines in the drawings.

While the strips 60 will function effectively to seal the side edges of the label holder pocket 26, affixing these strips in position may be difficult to do in a continuous manner and, therefore, would be labor-intensive. To overcome that problem, a modified embodiment of the instant inventive concepts is shown in FIG. 4 wherein parts similar to the embodiment of FIGS. 2 and 3 are designated by the same reference characters followed by a prime (′). In the embodiment of FIG. 4, in lieu of the strips 60 of resilient material, a continuous layer 80 of, for example, a closed-cellular foam material, is co-extruded to be integral with the polymer of the body panel 16. Thus, the label/sign holder 10′ of FIG. 4 is actually a tri-extrusion: the material of the body panel 16′ and the mounting elements being formed of a first, generally opaque, polymer material; the material of the layer 80 being of a second, resilient, polymer material; and the material of the cover member 18′ being of a third, transparent, polymer material. With such a construction, there is no need for the labor-intensive adhesive sealing of strips such as shown at 60 in FIGS. 2 and 3 at each side edge of the label holder pocket 26′ since the resilient nature of the layer 80, itself, acts to seal the label holder pocket about each of the labels carried therein.

It is also possible for the body panel of the label/sign holder itself it be formed of a resilient material such as a closed-cellular polyurethane foam or the like to provide a similar function. This would avoid the need for side strips and for a separate co-extrusion of a resilient layer.

Although FIGS. 2–4 illustrate the instant inventive concepts in a combination label/sign holder such as seen in the ’112 patent, it is to be understood that these concepts are equally applicable to a simple label holder of the type seen in FIG. 1 and that, while the combination label/sign holder has significant advantages discussed in the ’112 patent, the instant inventive concepts are not uniquely applicable to such a construction.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to falling within the scope of the invention.

What is claimed is:

1. In a label holder for use in a moist environment comprising a body panel having a top edge, a bottom edge, first and second spaced side edges, a front face and a rear face, a forwardly and downwardly extending top lip along said top edge of said body panel, said top lip having a freely extending front edge, a transparent cover member having a top edge, a bottom edge, first and second side edges, a front face and a rear face, a flexible hinge interconnecting said bottom edges of said body panel and said cover member to define a pocket between said front face of said body panel and said rear face of said cover member for removable reception of labels, said cover member being movable about said hinge between an open position providing access to said pocket and a closed position in which said top edge of said cover member underlies said top lip of said body panel to releasably secure said cover member in said closed position, the improvement which comprises a forwardly and downwardly extending ledge member along said top edge of said cover member, said ledge member underlying said top lip of said body panel in said closed position and having a freely extending front edge which is spaced forwardly and below said front edge of said top lip and forwardly of said front face of said cover member in said closed position to channel moisture forming on said top lip downwardly and away from labels contained in said pocket, and means for attaching said label holder to a supporting surface.

2. The improvement of claim 1 wherein said front edge of said ledge member is a rounded bead.

3. The improvement of claim 1 wherein said means for attaching said label holder to a supporting surface comprises adhesive on said rear face of said body panel.

4. The improvement of claim 1 wherein said means for attaching said label holder to a support surface comprises an attachment member carried by said rear face of said body panel.

5. The improvement of claim 4 wherein said supporting surface is a C-channel including a forwardly and downwardly extending upper lip defining a downwardly-opening upper pocket and a forwardly and upwardly extending lower lip defining an upwardly-opening lower pocket, said attachment member comprising a resilient attachment panel having an upper edge, a lower edge, a front face and a rear face, a spacer element interconnecting said rear face of said body panel with said front face of said attachment panel between said upper and lower edges of said attachment panel, whereby said attachment panel can be flexed to engage its upper edge in the upper pocket of the C-channel and its lower edge is in the lower pocket of the C-channel.

6. The improvement of claim 1 wherein said ledge member defines a downwardly-opening upper pocket, said cover member further including a forwardly and upwardly extending lower lip on its front face defining an upwardly-opening lower pocket, whereby a sign or sign holder can be supported in said upper and lower pockets on said front face of said cover.

7. The improvement of claim 1 further including strips of resilient sealing material attached to at least one of said rear face of said cover member and said front face of said body panel at least along its first and second side edges, whereby when said cover member is in said closed position, said side edges are sealed to limit access to said pocket by moisture.

8. The improvement of claim 7 wherein said strips of resilient sealing material are adhesively secured to said at least one of said cover member and said body panel.

9. The improvement of claim 7 wherein said sealing material is a closed celled foamed plastic.

10. The improvement of claim 9 wherein said plastic is polyurethane.

11. The improvement of claim 1 further including a layer of resilient sealing material covering substantially the entire surface of said front face of said body panel.

12. The improvement of claim 11 wherein said body panel and said layer of resilient sealing material are co-extruded from different plastics materials.

13. The improvement of claim 12 wherein said sealing material is a closed celled foamed plastic.

14. The improvement of claim 13 wherein said plastic is polyurethane.

15. The improvement of claim 1 wherein said body panel of said label holder is formed of a resilient material whereby, when said cover member is in said closed position, at least said side edges are sealed to limit access to said pocket by moisture.

16. The improvement of claim 15 wherein said resilient material is a closed celled foamed plastic.

17. The improvement of claim 16 wherein said plastic is polyurethane.

18. In combination, a supporting surface and a label holder for use in a moist environment, said label holder comprising a body panel having a top edge, a bottom edge, first and second spaced side edges, a front face and a rear face, a forwardly and downwardly extending top lip along said top edge of said body panel, said top lip having a freely extending front edge, a transparent cover member having a top edge, a bottom edge, first and second side edges, a front face and a rear face, a flexible hinge interconnecting said bottom edges of said body panel and said cover member to define a pocket between said front face of said body panel and said rear face of said cover member for removable reception of labels, said cover member being movable about said hinge between an open position providing access to said pocket and a closed position in which said top edge of said cover member underlies said top lip of said body panel to releasably secure said cover member in said closed position, a forwardly and downwardly extending ledge member along said top edge of said cover member, said ledge member underlying said top lip of said body panel in said closed position and having a freely extending front edge which is spaced forwardly and below said front edge of said top lip and forwardly of said front face of said cover member in said closed position to channel moisture forming on said top lip downwardly and away from labels contained in said pocket, and means attaching said label holder to said supporting surface.

19. The combination of claim 18 wherein said means attaching said label holder to a supporting surface comprises adhesive on said rear face of said body panel.

20. The combination of claim 18 wherein said means attaching said label holder to a support surface comprises an attachment member carried by said rear face of said body panel.

21. The combination of claim 20 wherein said supporting surface is a C-channel including a forwardly and downwardly extending upper lip defining a downwardly-opening upper pocket and a forwardly and upwardly extending lower lip defining an upwardly-opening lower pocket, said attachment member comprising a resilient attachment panel having an upper edge, a lower edge, a front face and a rear face, a spacer element interconnecting said rear face of said body panel with said front face of said attachment panel between said upper and lower edges of said attachment panel, said attachment panel being flexed with its upper edge engaged in said upper pocket of said C-channel and its lower edge engaged in said lower pocket of said C-channel.

22. The combination of claim 18 wherein said ledge member defines a downwardly-opening upper pocket, said cover member further including a forwardly and upwardly extending lower lip on its front face defining an upwardly opening lower pocket, further including a sign holder supported in said upper and lower pockets on said front face of said cover.

23. The combination of claim 18 further including strips of resilient sealing material attached to at least one of said rear face of said cover member and said front face of said body panel at least along its first and second side edges, whereby, when said cover member is in said closed position, said side edges are sealed to limit access to said pocket by moisture.

24. The combination of claim 23 wherein said strips of resilient sealing material are adhesively secured to said at least one of said cover member and said body panel.

25. The combination of claim 24 wherein said sealing material is a closed celled foamed plastic.

26. The combination of claim 25 wherein said plastic is polyurethane.

27. The combination of claim 18 further including a layer of resilient sealing material covering substantially the entire surface of said front face of said body panel.

28. The combination of claim 27 wherein said body panel and said layer of resilient sealing material are co-extruded from different plastics materials.

29. The combination of claim 28 wherein said sealing material is a closed celled foamed plastic.

30. The combination of claim 29 wherein said plastic is polyurethane.

31. The combination of claim 18 wherein said body panel of said label holder is formed of a resilient material whereby, when said cover member is in said closed position, at least said side edges are sealed to limit access to said pocket by moisture.

32. The combination of claim 31 wherein said resilient material is a closed celled foamed plastic.

33. The combination of claim 32 wherein said plastic is polyurethane.

* * * * *